United States Patent [19]

Foscolo

[11] 4,037,554

[45] July 26, 1977

[54] COMBINATION GAFF AND BOAT HOOK

[76] Inventor: Peter F. Foscolo, 4565 Middlesex Road, Wilmington, N.C. 28401

[21] Appl. No.: 681,387

[22] Filed: Apr. 29, 1976

[51] Int. Cl.[2] ..... B63B 21/54

[52] U.S. Cl. ..... 114/221 R; 7/1 H; 43/5; 294/24

[58] Field of Search ..... 114/221 R; 115/9; 294/2, 24, 26; 7/1 H; 43/5, 6

[56] References Cited

U.S. PATENT DOCUMENTS

| | | | |
|---|---|---|---|
| 1,920,790 | 8/1933 | Hendrie | 43/5 |
| 3,040,693 | 6/1962 | Bunker | 114/221 R |
| 3,072,428 | 1/1963 | Johnson | 43/5 X |
| 3,150,460 | 9/1964 | Dees | 43/6 |
| 3,311,398 | 3/1967 | Erhardt | 294/26 X |
| 3,618,147 | 11/1971 | Gaskill | 7/1 H |

*Primary Examiner*—Trygve M. Blix
*Assistant Examiner*—Gregory W. O'Connor
*Attorney, Agent, or Firm*—Joel Halpern

[57] ABSTRACT

A combination gaff and boat hook includes a rigid longitudinal handle element and a gaff element affixed thereon. A rigid enclosure conforming generally to the shape of the gaff element is adapted to sheath the gaff element and be affixed to the handle element. The enclosure, when in position sheathing the gaff serves as a boat hook.

4 Claims, 5 Drawing Figures

COMBINATION GAFF AND BOAT HOOK

BACKGROUND OF THE INVENTION

The present invention relates to fishing and nautical equipment, and more particularly, to a combination gaff and boat hook.

One of the major concerns of boating is the maximum utilization of the limited space available. Boat hooks for use in docking and gaffs for use to gaff fish while fishing are two of the more common tools required while boating. These tools are used on most fishing trips but rarely are used at the same time.

The desirability of boating tools which can be used alternately as boat hooks and gaffs in the interest of conserving space are well known in the prior art. A combination pike pole and boat hook having a spring urged housing adapted to enclose the pike when not in use in disclosed in U.S. Pat. No. 3,072,428 to Johnson issued Jan. 8, 1963. However, the spring mechanism is subject to corrosion and ultimate seizure as a result of exposure of the tool to the salt water and sea air environment. Eventually use of the pike will be precluded.

U.S. Pat. No. 3,618,147 to Gaskill issued Nov. 9, 1971 discloses the provision of a hook shaped element affixed to a longitudinal handle. A gaff may be removably affixed to the free end of the hook shaped element. However, handling of the pointed gaff while it is being affixed to the handle or being removed therefrom for storage may pose a safety problem.

The present invention overcomes the problems of the prior art by providing a combination gaff and boat hook which is quickly, easily, and safely converted from one use to the other and which may be exposed to salt water and sea air with negligible effects.

SUMMARY OF THE INVENTION

Therefore, it is a primary object of the present invention to provide a combination gaff and boat hook which is quickly, easily, and safely converted from one use to the other.

Another object of the present invention is to provide a combination gaff and boat hook which is negligibly affected by exposure to salt water and sea air.

A further object of the present invention is to provide a combination gaff and boat hook which is simple in design and durable.

These objects, as well as further objects and advantages, of the present invention will become readily apparent after reading the following description of a non-limiting illustrative embodiment and the accompanying drawing.

According to the present invention there is provided a combination gaff and boat hook comprising:

- a rigid elongated rod-like element;
- a gaff element secured fixedly to one end of said rod-like element;
- a sheath for said gaff element adapted to be removably positioned thereover and to be connected adjacent one end thereof to said pole-like element to form an extension thereof, said sheath being shaped to present a boat hook at the other end thereof.

BRIEF DESCRIPTION OF THE DRAWINGS

In order that the present invention may be more fully understood it will now be described, by way of example, with reference to the accompanying drawings in which.

DETAILED DESCRIPTION OF THE INVENTION

Figure 1:
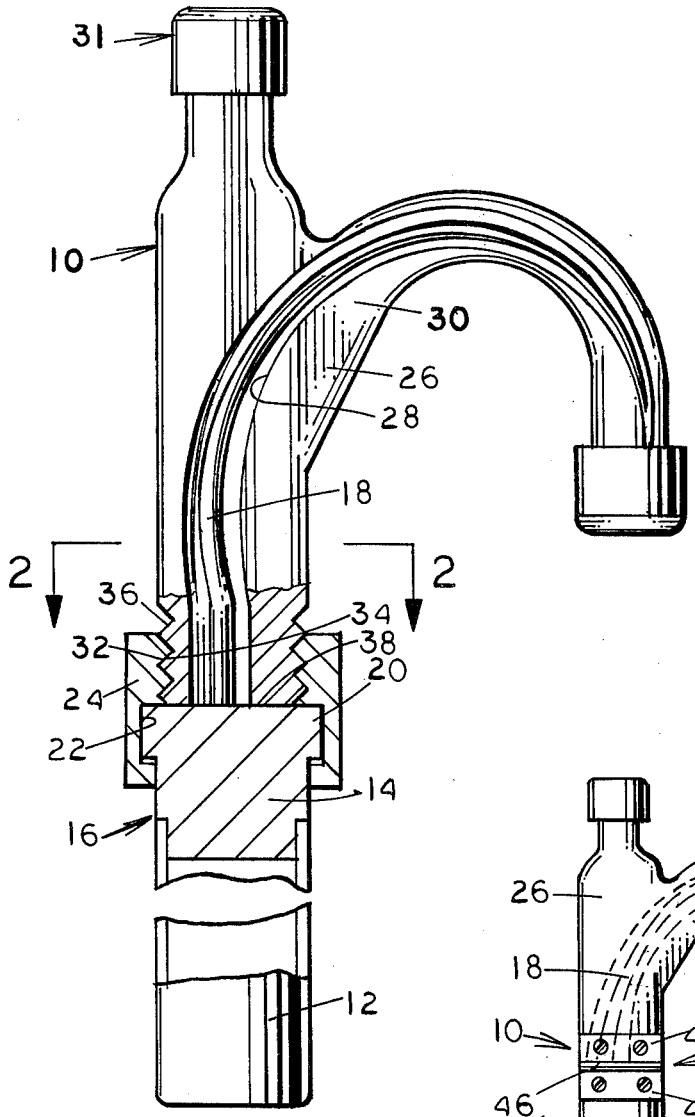
FIG. 1 is a side view partially broken away and partially in cross-section, of a combination gaff and boat hook embodying the features of the invention.
Figure 2:
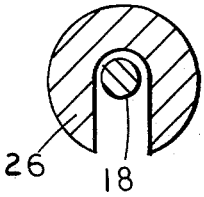
FIG. 2 is a cross-sectional view of the gaff and boat hook of FIG. 1 taken along the line 2—2 thereof.

Referring to the drawings, and more particularly to FIG. 1 thereof, there is shown generally, as indicated by reference numeral 10, a combination gaff and boat hook. The implement includes a rigid elongated rod or pole-like element 12 which is desirably formed of a strong light-weight material. If utilized in the form of a hollow rod, a plug 14 is preferably positioned within one end 16 of the rod to provide a base for fixedly securing a gaff element 18 thereto. The gaff element 18 is given the arcuate configuration of a hook as shown. In the event a solid rod is employed then the gaff element 18 is secured fixedly to end 16 of the rod. Any known and convenient manner of affixing the gaff to the end of the rod may be utilized.

The end of the rod 12 to which the gaff 18 is secured is provided with a peripherally extending enlarged head 20 which, as will be described hereafter, is dimensioned to fit within a recess 22 in a lock nut 24 to thereby couple a sheath 26 for the gaff 18 to the rod or pole 12. The sheath 26 has a slit 28 formed in a side wall 30 thereof which is dimensioned and configured to permit the insertion of the gaff element 18 therethrough during sheathing and unsheathing thereof. The sheath 26 further provides a longitudinal push off extension 31 adapted to be used in a conventional manner. When secured to the rod or pole 12 the sheath 26 constitutes a longitudinal extension thereof. The sheath 26 is removably affixed to the end 16 of the pole element 12 by means of a lock nut 24 as stated above. The lock nut 24 is provided with an interior recess 22 which is shaped and dimensioned so as to rotatably receive the enlarged head 20 of the pole element 12. An interior portion 32 of the lock nut 24 remote from the end 16 of the pole 12 is threaded so as to threadably cooperate with the threads 34 formed on the outer surface 36 of the sheath 26 adjacent the end 38 thereof. Rotation of the lock nut 24 thus fixedly secures the sheath 26 to the pole element 12 with the gaff element 18 sheathed therein. The sheath 26 may be removed by reverse rotation of the lock nut 24 by shifting the sheath laterally such that the gaff element 18 passes through the slit 28.

Figure 4:
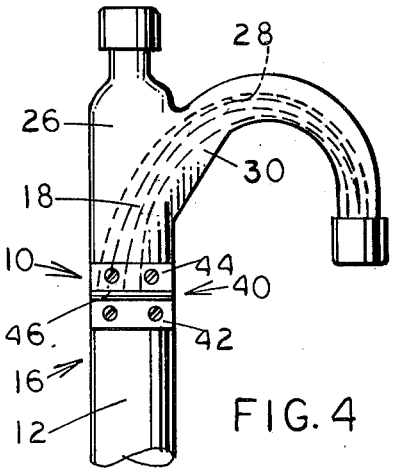
FIG. 4 is a view of the embodiment shown in FIG. 3 and in which the gaff element is sheathed.
Figure 3:
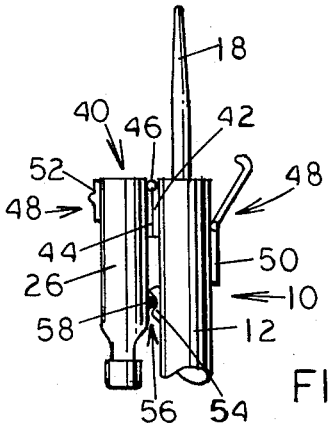
FIG. 3 illustrates an alternate construction whereby the gaff element is exposed.

FIGS. 3 and 4 illustrate an alternate construction for the sheathing and unsheathing of the gaff 18. Such construction includes a hinge menber 40 having a first flange portion 42 affixed to the end 16 of the pole element 12 and a second flange portion 44 affixed to the sheath 26. The first and second flange portions 42 and 44 rotate about a pin element 46 thereof permitting the tilting of the sheath 26. As the sheath 26 is tilted from the sheathed position shown in FIG. 4 toward the unsheathed position shown in FIG. 3 the gaff 18 passes through the slit 28 and is exposed for use. A clamp element 48 is remotely secured by a first portion 50 thereof to the pole element 12 and by a second portion 52 thereof to the sheath 26. The first portion 50 is adapted to rivot, engage and thereby secure a protuberance provided on the second portion 52 when disposed adjacent thereto. A female portion 54 of a snap element 56 is affixed to the pole element 12. A male portion 58 of the snap element 56 is affixed to the sheath 26. The female portion 54 is adapted to secure the male portion 58 therein when the sheath 26 is positioned against the pole element 12 as shown in FIG. 3 thereby releasably locking the sheath in a position which permits the use of the gaff 18.

Figure 5:
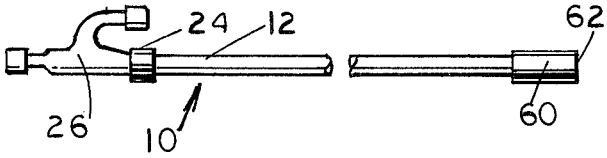
FIG. 5 illustrates a side view of the embodiment shown in FIG. 1 with the gaff element sheathed and the sheath serving as the boat hook.

The pole element 12 preferably includes a grip element 60 disposed adjacent to free end 62 thereof as shown in FIG. 5.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A combination gaff and boat hook comprising:

a rigid elongated rod-like element;

a gaff element secured fixedly to one end of said rod-like element;

a sheath for said gaff element adapted to be removably positioned thereover and to be connected adjacent one end thereof to said rod-like element to form an extension thereof, said sheath being shaped to present a boat hook at the other end thereof;

a slit formed in the side wall of said sheath element adapted to permit the passage of said gaff therethrough during sheathing and unsheathing therof, said sheath providing the housing for and defining therein an arcuate through bore dimensioned and configured to receive said gaff element therein;

and a lock nut for removably positioning said sheath over said gaff and for coupling said sheath to said rod-like element, an interior recess being formed in said nut configured and dimensioned to rotatably receive a peripherally extending enlarged head on one end of said rod-like element, the longitudinal axis of said lock nut being coaxial to the longitudinal axis of said rod-like element, and an interior portion of said lock nut remote from said one end of said rod-like element being adapted to threadedly cooperate with threads formed on the outer surface of said sheath on the end thereof adjacent to said one end of the rod-like element, the rotation of said lock nut being adapted to selectively couple said sheath and rod-like element with the sheath in position sheathing said gaff element.

2. A combination gaff and boat hook comprising:

a rigid elongated rod-like element;

a gaff element secured fixedly to one end of said rod-like element;

a sheath for said gaff element adapted to be removably positioned thereover and to be connected adjacent one end thereof to said rod-like element to form an extension thereof, said sheath being shaped to present a boat hook at the other end thereof said sheath having a slit formed in a sidewall thereof;

hinge means including a pair of flanges one of which flanges is secured to said rod-like element and the second flange is secured to said sheath, said hinge means being pivotable to thereby permit the tilting of said sheath and the passage of said gaff element through said slit to unsheath said gaff element.

3. A combination gaff and boat hook according to claim 2, further including a closure means including a clamp element having a first portion thereof affixed to said rod-like element and a second portion thereof affixed to said sheath, said first portion being adapted to lockingly engage said second portion.

4. A combination gaff and boat hook according to claim 2, further including means for retaining said sheath in an unsheathed position, said means comprising cooperative fastening elements.

* * * * *